US005248153A

United States Patent [19]

Jones

[11] Patent Number: 5,248,153

[45] Date of Patent: Sep. 28, 1993

[54] LOST OBJECT GAME APPARATUS AND METHOD

[76] Inventor: Gary C. Jones, 12 Yeoman Dr., West Yarmouth, Mass. 02673

[21] Appl. No.: 947,255

[22] Filed: Sep. 18, 1992

[51] Int. Cl.[5] ..... A63F 9/00
[52] U.S. Cl. ..... 273/459; 294/55
[58] Field of Search ..... 273/459, 440, 447, 448; 294/55; 209/417, 418

[56] References Cited

U.S. PATENT DOCUMENTS

| | | | |
|---|---|---|---|
| 3,960,377 | 6/1976 | Doyle | 273/459 |
| 3,976,564 | 8/1976 | Holder | 294/55 X |
| 4,983,281 | 1/1991 | Montelione | 209/418 |
| 5,076,627 | 12/1991 | Simon | 209/417 X |

FOREIGN PATENT DOCUMENTS

| | | | |
|---|---|---|---|
| 134622 | 10/1949 | Australia | 294/55 |
| 498732 | 2/1951 | Belgium | 273/459 |

*Primary Examiner*—Paul E. Shapiro
*Attorney, Agent, or Firm*—Thomas A. Kahrl

[57] ABSTRACT

A game apparatus adapted for use by a searcher for retrieving buried objects comprising in combination, a defined search area having a generally rectangular configuration defined by an elongated demarcation ribbon; a scoop having sifting grates for rapidly sifting soil in order to locate objects buried in said soil comprising a bottom grate, a first side grate and a second side grate, and a rear wall grate, and a lip; a handle affixed to the scoop adapted to be manually grasped by one hand; a plurality of game pieces, each piece being visually different and grid markers for organizing the search pattern wherein the searcher systematically searches a the search area for articles buried in the playing area.

11 Claims, 3 Drawing Sheets

LOST OBJECT GAME APPARATUS AND METHOD

BACKGROUND OF THE INVENTION

Locating and retrieving lost objects, particularly objects misplaced and buried while at a beach or seashore, having a substantial value such as jewelry, money, watches, or are important, such as car keys, which are typically buried in the sand while sunbathing, is particularly troublesome. Initial attempts to locate and retrieve such lost objects are done either manually or with children's play items such as small plastic shovels and pails, and frequently prove to be ineffective, as the search is done in a non-systematic manner, and as a result, it becomes difficult for the searchers to determine the area searched and what has not. Furthermore, in the absence of proper search tools, the searchers utilize their hands or small implements which are not adapted to comprehensively cover a substantial search area. Prior art search devices such as electronic metal detectors, while proving effective to locate metallic objects in areas immediately under the search device, do not provide for retrieval and are not related to a comprehensive search pattern. As a result, often where lost items are of great value or importance are concerned, the searcher tends to go back over and over the same area with repeated searches with less and less organized search pattern consuming a great deal of time and generating a great deal of frustration, with only mixed results.

The present invention relates to a game apparatus of the variety adapted in locating lost objects which may be used both as a game and as a highly effective tool for locating objects misplaced and buried at a recreational area, such as a sandy beach. The game device played as a game provides for amusement for children involving ever popular interaction with the sand and looking for buried "treasure" and includes educational value in that it teaches a method for locating lost objects. Certain prior art games are known which are directed to locating lost buried "Pirate Treasure" typically buried in the sandy beach where sequential clues are provided which must be solved by the players to advance to the next clue, and ultimately to the treasure. Other prior art devices employ simulated ancient maps which must be deciphered in order to find the buried treasure.

It is therefore desirable to provide for a new and improved lost object game apparatus which may be employed in play environments found at sandy beaches or other recreational areas which may be used either as a game for amusement or a useful tool for finding lost objects which has the advantage of use and utility not possessed by prior art lost object games or retrieval devices.

SUMMARY OF THE INVENTION

The invention relates to a game apparatus for locating and retrieving buried lost objects either as a game or as a tool, for locating lost objects and to a method of searching for buried objects by establishing a preselected order of search on the ground surface of an outdoor area, particularly a play environment found at sandy beaches.

In particular, the invention concerns a game apparatus wherein a scoop, having a defined width is employed to sift the surface soil through grate devices provided in the scoop, in a defined playing area, to locate a plurality of buried game pieces. The play area can also be alternatively defined as a search area where the scoop is being used, not as a game device, but as a tool to locate lost objects. The playing/search area is defined by an elongated demarcation device having regularly spaced grid markers for establishing reference points for a search grid for organizing a search pattern wherein the spacing of the grid markers is related to the width of the scoop.

In the preferred embodiment, the scoop employed in game apparatus is constructed of lightweight, resilient plastic material configured with a plurality of sifting grates, employing a large size mesh grid adapted for rapidly sifting soil, typically sand, to locate and retrieve objects buried therein. In this embodiment, the sifting surfaces comprise at least four separate grates comprising a base grate, a first and second side grate, and a back grate, having a large mesh size of at least ½" to ⅞". It is recognized that the mesh size can be varied however, a large mesh size is preferred for rapid sifting, for game purposes or alternatively in the search mode for rapidly covering a large search area. The sifting grates comprise a bottom grate having a width of 8⅛", a first side grate and a second side grate, and a rear wall grate, each of which have a large mesh size equal to the bottom grate with the bottom grate including a forward extending lip. The scoop further includes a handle constructed of resilient material, typically plastic material, that is integrally affixed to the back and bottom grate portions of the scoop, being adapted to be manually grasped by one hand of a player. The handle extends rearwardly a distance of no longer than 5" and is constructed of lightweight plastic material used to construct the scoop.

The preferred embodiment includes a plurality of sets of visually different game pieces, with each set consisting of a plurality of at least four game pieces and each piece being constructed to simulate different objects, which would be the normal object of a search such as jewelry, a key, a coin or a watch. In this embodiment, the game pieces typically include at least two watches, at least two keys, at least two rings, and at least two coins. The game pieces are constructed of plastic, nonmetallic material.

The preferred embodiment further provides an elongated demarcation device for defining a playing/search area, typically 30 inches in width and four feet in length, to be secured in a playing mode on a ground surface, said demarcation device comprising an endless outer boundary demarcation marker of a length sufficient to mark the boundary of the playing/search area of the game. The playing/search area is defined typically in a generally rectangular configuration by the elongated demarcation device with piles of sand being placed at the four corner points. Typically, the playing/search are demarcation device comprises a cloth ribbon.

The elongated demarcation device also includes a plurality of spaced grid markers is provided comprising a series of visually different marks spaced at intervals, said intervals equal to the width of the bottom grate of the scoop, for providing a plurality of grid points in spaced-apart relationship along the demarcation device, such that spaced apart parallel lines may be drawn in the soil/sand extending between the top and bottom of the square and between the side points for use and reference for creating a systematic search pattern.

Method of Play

OBJECT It is the object of the game to locate a plurality of buried game pieces totaling at least eight player pieces of non-metallic construction by rapidly sifting the entire surface of a defined playing area in a systematic manner. The game may be played either by two individual players, or as team players. The game devices include two scoops, two ribbons, eight player pieces including two simulated watches, two simulated keys, two simulated rings and two simulated coins. Each team selects one scoop, and one set of player pieces including one each of the four player pieces, the player pieces are visually different by color as are the two scoops as are the ribbons. Each team selects a ribbon, for example, team one would select a red ribbon, a red scoop, and a red watch, key, ring and a coin, whereas team two would select a blue ribbon, a blue scoop, and a set of blue player pieces comprising a watch, a key, a ring and a coin. Each team lays out the ribbon in a similarly rectangular configuration and piles a hill of sand on each corner to hold the ribbon in place. Team one then hides team one's objects in the sand while team two looks away. Team two then will hide team two's objects in team one's square in the sand while team one looks away.

At the start of a timer, team one will scoop one scoop of sand, in team one's square and if no object is found in that scoop, it will be team two's turn to scoop one scoop of sand in team two's square. If an object is found in the scoop, that player will scoop again until no object is found. The first team to find all of the objects on the other team's square is the winner. In the event that are two players on each team, the players will take turns using the scoop.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
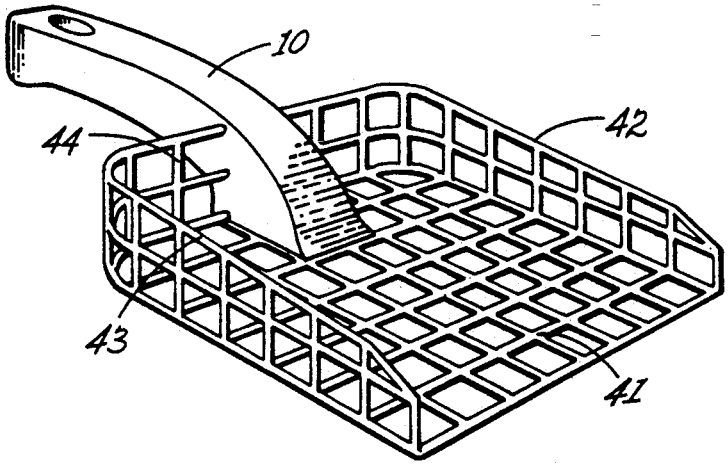
FIG. 1 Is an isometric view of the scoop of the present invention in three-dimensional form.
Figure 2:
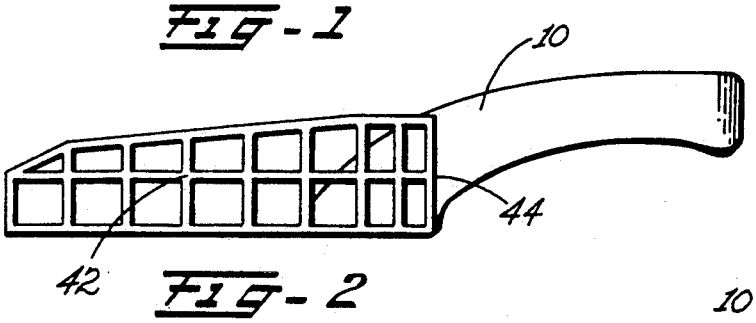
FIG. 2 Is a side view of the scoop of FIG. 1.
Figure 3:
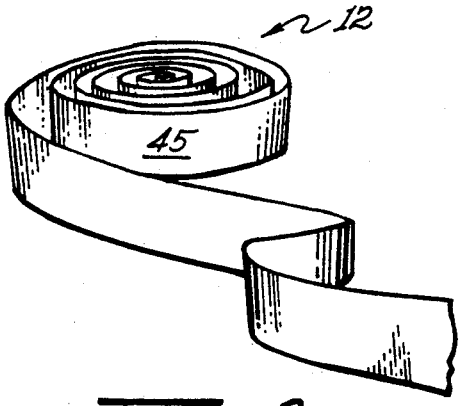
FIG. 3 Is an isometric view of a demarcation device of the invention showing a roll of ribbon.
Figure 4:
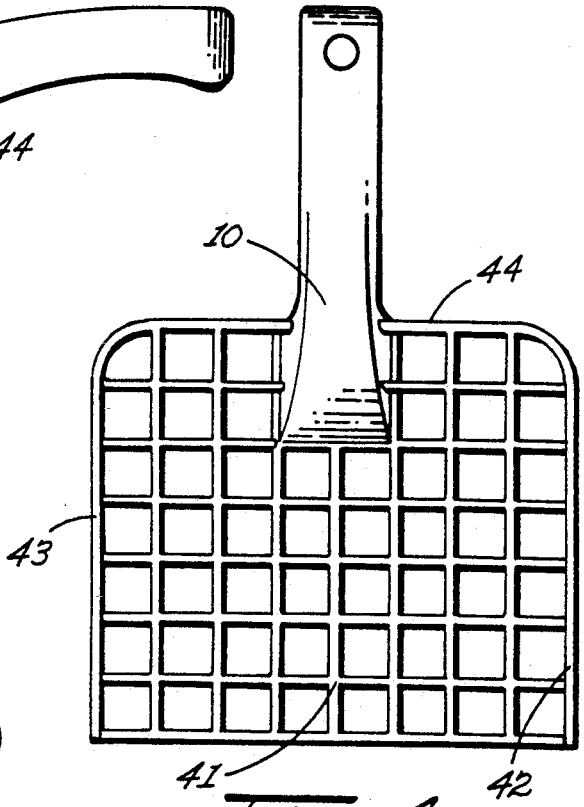
FIG. 4 Is a perspective view from above of the scoop of FIG. 1 showing the enlarged mesh size of the bottom grate.
Figure 5:
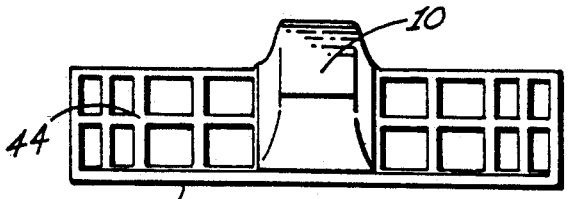
FIG. 5 Is a back elevational view of the scoop of FIG. 1.
Figure 6:
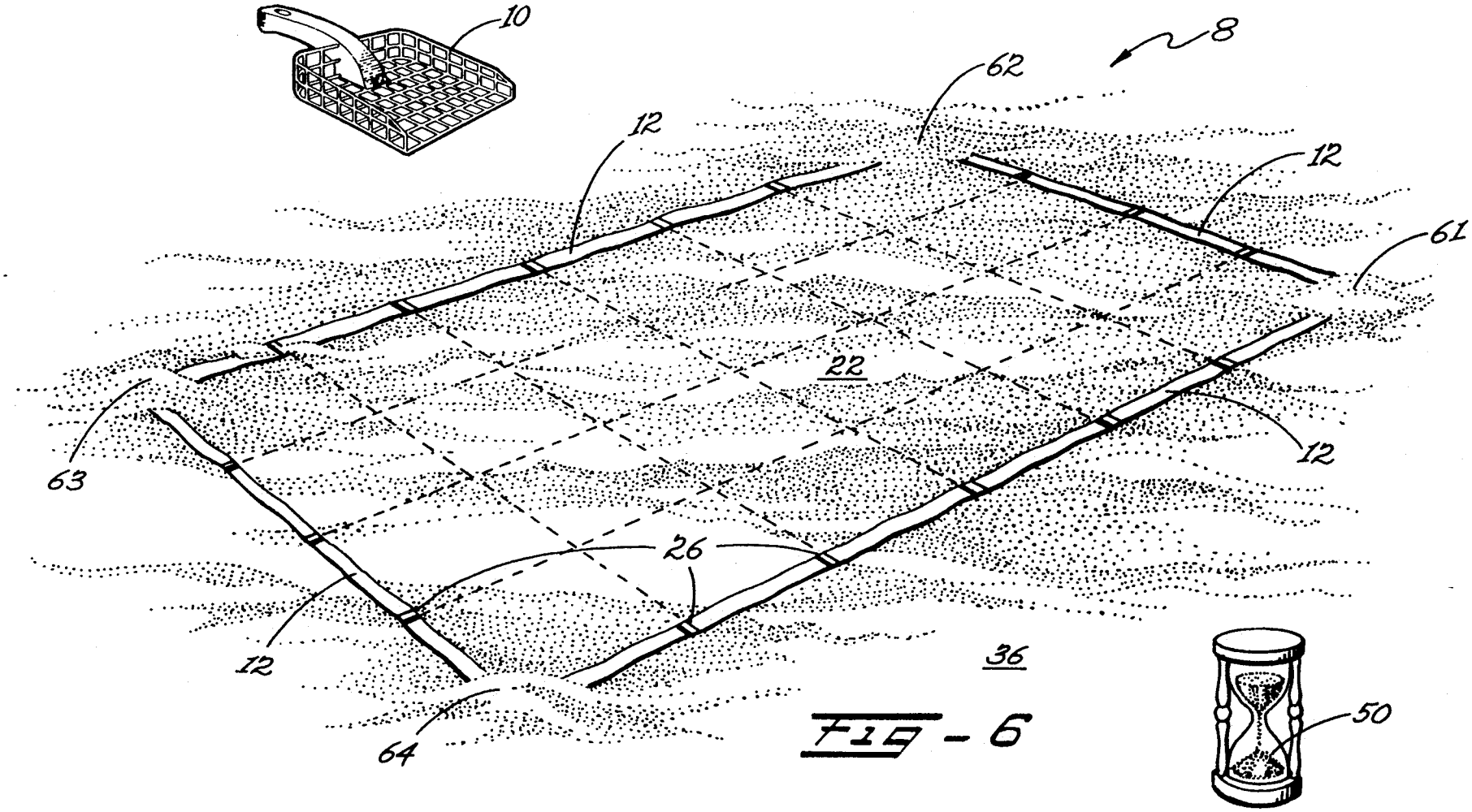
FIG. 6 Is a pictorial view of the present game apparatus of the invention in use and illustrated in a playing mode with game pieces varied and the corners of the rectangular playing defined by lumps of sand and showing the grid marking devices fixed to the ribbon to define the border markers of a grid system.
Figure 7:
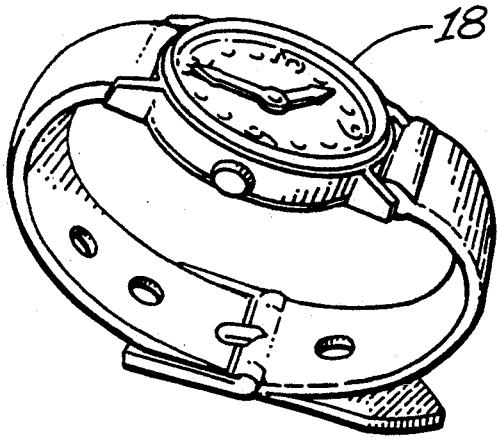
FIGS. 7–10 Show the game pieces description of the embodiment in the next section.
Figure 8:
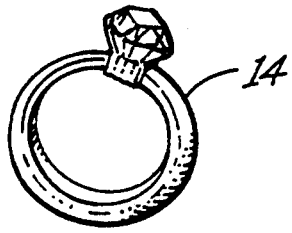
Figure 9:
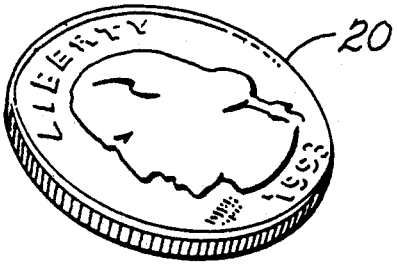
Figure 10:
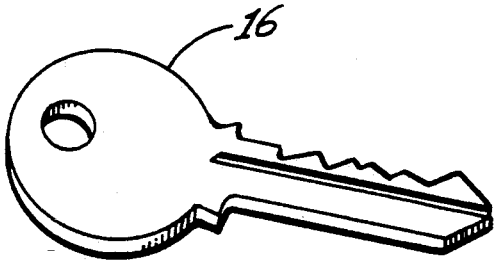

Referring to the Figs., and in particular FIGS. 1, 3, 6, and 7–10, is shown a Lost Object Game Apparatus 8 comprising a scoop 10, a demarcation device 12 and game pieces 14, 16, 18, and 20 and a playing/search area generally at 22 in FIG. 6. A grid marking device 26 is provided on the demarcation device 12 that is shown in FIGS. 3 and 6. The game apparatus 8 is adapted for use by a player/searcher to locate one or more of said game pieces 14,16,18 or 20 to be buried in the playing/search area 22, said playing area being of generally rectangular configuration defined by the elongated demarcation device 12.

The scoop 10 is of light-weight, resilient construction adapted for one handed operation comprising a plurality of grate members 41,42,43 and 44 for rapidly sifting soil 30 to retrieve one of said game pieces buried in said soil, a lip 32 and a handle 34 affixed to the scoop 10 adapted to be manually grasped by one hand. The plurality of game pieces, each piece being visually different comprise a first game piece characterized as a ring 14, a second game piece characterized as a key 16; a third game piece characterized as a watch 18, a fourth game piece characterized as a coin 20. The a search area demarcation device 12 is adapted for defining the playing area 22 to be secured in a playing mode on a ground surface 36 comprising an endless outer boundary demarcation marker of a length sufficient to mark the boundary of said play area.

In an alternate embodiment, the scoop 10 is used to locate a lost object and the demarcation device 12 is used to define a search area.

In the preferred embodiment, said grid markers 24 utilized for organizing the search pattern comprise a plurality of grid points in spaced apart relationship along the demarcation device 12, a conventional ribbon 45, the distance apart being equal to the width of the bottom grate 41, wherein the searcher systematically searches a the search area for articles buried in the playing area. The grate members comprise a bottom grate 41, a first side grate 42 and a second side grate 43, and a rear wall grate 44. The demarcation device 12 is anchored at corner points 61, 62, 63 and 64 with mounds of sand. Said demarcation device may be constructed of a cloth tape or rope, and is marked at intervals equal to the width of the scoop 10.

The invention also comprises a method and apparatus for locating and retrieving articles lost, particularly at a beach, being obscured from view, including a retrieval apparatus comprising a scoop with a plurality of grates and a ribbon means for marking a rectangular grid related to the retrieval apparatus for systematically searching a given area typically an area of a beach for lost articles such as coins, car keys, watches and jewelry wherein the retrieval means comprises a scoop with a plurality of grates contained in a frame having a handle for use by one hand; the grate being adapted having a relatively large mesh size for permitting soil such as sand to pass through rapidly leaving the objects retained on the grate for retrieval.

What is claimed is:

1. A game apparatus directed to retrieving buried objects comprising in combination:

a) a scoop of light-weight, resilient construction adapted for one handed operation comprising grate means for rapidly sifting soil means to locate and retrieve objects located buried in said soil and a handle affixed to the scoop, extending rearwardly, adapted to be manually grasped by one hand extending a distance of no more than 6";

b) a search area demarcation means for defining a search area to be secured in a playing mode on a ground surface comprising an endless outer boundary demarcation marker of a length sufficient to mark the boundary of the search area;

c) a playing area having a generally rectangular configuration defined by said search area demarcation means;

d) a plurality of game pieces, each piece being visually different e) grid means for organizing the search pattern comprising a plurality of grid points in spaced apart, relationship along the boundary demarcation marker, the apart being equal to the width of the bottom grate wherein the searcher systematically searches a the search area for articles buried in the playing area.

2. The game apparatus of claim 1 wherein the grate means of the scoop comprises a bottom grate, a first side grate and a second side grate, and a rear wall grate.

3. The game apparatus of claim 1 wherein the soil means comprises sand.

4. The game apparatus of claim 3 further comprising means for anchoring said boundary demarcation at corner points with mounds of sand.

5. The game apparatus of claim 1 wherein the playing area is a beach.

6. The game apparatus of claim 1 further comprising means for anchoring said boundary demarcation at corner points.

7. The game apparatus of claim 1 in which said boundary demarcation is a cloth tape.

8. The game apparatus of claim 1 wherein the boundary demarcation is a rope and is marked at intervals equal to the width of the scoop.

9. The game apparatus of claim 1 wherein the plurality of game pieces comprises:

i) a first game piece simulating a ring ii) a second game piece simulating a key;

iii) a third game piece simulating a watch;

iv) a fourth game piece simulating a coin.

10. A search and retrieval apparatus adapted for use by a searcher for retrieving buried objects comprising in combination:

a) a search area having a generally rectangular configuration defined by an elongated demarcation means;

b) a scoop having a sifting means for rapidly sifting soil in order to locate objects buried in said soil, said sifting means comprising a bottom grate, a first side grate and a second side grate, and a rear wall grate, and a lip;

c) a handle affixed to the scoop adapted to be manually grasped by one hand;

d) a search area demarcation means for defining a search area to be secured in a playing mode on a ground surface comprising an endless outer boundary demarcation marker of a length sufficient to mark the boundary of the search area;

e) grid means for organizing the search pattern comprising a plurality of grid points in spaced apart relationship along the boundary demarcation marker, the distance apart being equal to the width of the bottom grate wherein the searcher systematically searches a the search area for articles buried in the search area.

11. A method for establishing a pre-selected order of searching for lost objects including establishing a grid for searching a large area comprising;

a) providing an elongated boundary marker having a one and other end;

b) providing a scoop as in claim 1 for sifting soil in the defined playing area;

c) defining a playing area having a generally rectangular configuration defined with an said elongated boundary marker;

d) marking the boundary marker in intervals equal to the width of the scoop;

e) providing a plurality of game pieces each piece having a distinct shape;

f) hiding the game pieces by burying them in random locations in soil in the play area;

g) installing the boundary marker to define a rectangular search area by anchoring one end of said boundary marker in the soil and laying out the boundary marker and placing soil on each of the four corners of the rectangular playing area;

h) providing a timer for timing intervals and starting the timer;

i) sifting the soil means of the scoop within the contained area of the defined rectangle in a preselected order following a grid established by the boundary markers in paragraph g from the scoop; and j) collecting the game pieces.

* * * * *